US006912943B2

(12) United States Patent
Bolhassani

(10) Patent No.: US 6,912,943 B2
(45) Date of Patent: Jul. 5, 2005

(54) BULLET SIZING AND LUBRICATING DEVICE

(76) Inventor: Mehdi Bolhassani, Bldg. No. 200-Vessale Shomali Ave., Shiraz, Fars 71396 (IR)

( * ) Notice: Subject to any disclaimer, the term of this patent is extended or adjusted under 35 U.S.C. 154(b) by 86 days.

(21) Appl. No.: 10/633,861

(22) Filed: Aug. 4, 2003

(65) Prior Publication Data

US 2005/0039595 A1 Feb. 24, 2005

(51) Int. Cl.[7] ..... F42B 14/04
(52) U.S. Cl. ..... 86/19; 86/24
(58) Field of Search ..... 86/19, 23, 24, 86/27, 44

(56) References Cited

U.S. PATENT DOCUMENTS

| | | | | | |
|---|---|---|---|---|---|
| 97,806 | A | * | 12/1869 | Pickersgill | 86/19 |
| 476,175 | A | * | 5/1892 | Stewart | 86/19 |
| 2,019,795 | A | * | 11/1935 | Peterson | 86/19 |
| 2,133,873 | A | * | 10/1938 | Sharp | 86/19 |
| 2,403,032 | A | * | 7/1946 | Stevens, Jr. | 86/19 |
| 2,510,430 | A | * | 6/1950 | Stevens, Jr. | 86/19 |
| 2,535,616 | A | * | 12/1950 | Wadman et al. | 86/19 |
| 3,005,372 | A | * | 10/1961 | Hall | 86/19 |
| 3,736,835 | A | * | 6/1973 | Hanson | 86/19 |
| 4,108,044 | A | * | 8/1978 | Brown | 86/19 |
| 4,217,809 | A | * | 8/1980 | Hertzler | 86/19 |
| 4,434,571 | A | * | 3/1984 | Eisenhuth | 42/90 |
| 4,462,298 | A | * | 7/1984 | Engles | 86/19 |
| 4,817,491 | A | * | 4/1989 | Fenton | 86/19 |

* cited by examiner

*Primary Examiner*—Jack Keith
*Assistant Examiner*—Troy Chambers
(74) *Attorney, Agent, or Firm*—Philip J. Lee

(57) ABSTRACT

A bullet sizing and lubricating device is mountable in an ammunition reloading press to perform bullet sizing and lubricating in one stage with only a single operation of the press lever by using the force generated by the sizing operation to pressurize lubricant causing the lubricant to flow through ports to lubricate a bullet, the device simultaneously performing the sizing of one bullet and the lubrication and expulsion of a previously sized bullet as the bullets are passed axially through the device, the lubricant being pressurized by a piston engaged by a slidably sizing die while a previously sized bullet is retained within a lubricating assembly.

5 Claims, 3 Drawing Sheets

BULLET SIZING AND LUBRICATING DEVICE

BACKGROUND OF THE INVENTION

A. Field of Invention

The present invention relates generally to bullet sizing devices and bullet lubricating devices and more particularly, to a new and improved bullet sizing and lubricating device for use in an ammunition reloading press.

B. Description of Related Art

Conventionally, many target shooters practice ammunition reloading to reduce the cost of their practice and participation in this sport and refer to the reloading as "hand loading" despite the fact that a variety of tools and mechanical devices are used. Basic equipment for non commercial ammunition reloading generally includes a lever actuated press with which the reloader performs a variety of tasks incidental to ammunition reloading which require or are beneficially performed by the controlled use of force provided by such a press. Those hand loaders who use cast lead bullets prefer to size their bullets to improve shooting accuracy and to lubricate their bullets to prevent lead fouling of the gun barrel. The sizing process comprises forcibly passing the bullet through a die with a precisely dimensioned central bore appropriate to the desired bullet diameter. The lubrication process commonly involves using a device that exposes the bullet to pressurized lubricant. Bullet lubricant components vary but usually comprise a waxy substance that is highly viscous and not free flowing under normal operating temperatures. Common devices used for lubrication of bullets include manual pressure pumping devices, typically a threaded piston of piston driver that is manually rotated as desired to maintain the pressure of the lubricant. Devices that are available for bullet lubrication are either not combined with sizing devices, or are manual and therefore slow to operate, or are automatic but relatively intricate and expensive.

A need exists for a simple, automatic and effective device for sizing and lubricating bullets that can be mounted and operated efficiently and rapidly in an ammunition reloading press. Such a simplified design would be expected to be relatively inexpensive and easy to maintain and operate. Providing these functions in a single tool or stage would be advantageous and allow greater efficiency and speed in the reloading process.

SUMMARY OF THE INVENTION

The device of the present invention is a press mountable tool that performs the bullet sizing and bullet lubricating functions in one stage with a single operation of the press lever. The operation of the device simultaneously performs the sizing of one bullet and the lubrication and expulsion of a previously sized bullet. As will be described further, a second bullet is passed linearly through a sizing die into a lubrication station where the second bullet replaces and expels a first, previously sized, bullet, the first bullet having been lubricated while the second bullet is sized, and the second bullet then awaits the sizing of the next bullet which will in turn cause the second bullet to be lubricated and expelled. With each operation of the press lever, the punch enters and is retracted from the device and a sized and lubricated bullet is expelled from the device. Since the cast bullet forms are generally slightly greater than desired diameter, the process of forcibly passing the bullet through a sizing die results in generation of axial force. The device of the present invention uses the axial force generated by the sizing process to pressurize the lubricant to cause sufficient flow for lubrication of a previously sized bullet, thereby eliminating the need for external means for pressurization of the lubricant.

The device comprises a body, externally threaded for installation into a reloading press, the body having a central bore, and a punch, of smaller diameter than the desired size of the finished bullet, the punch being installed onto the ram of a reloading press and aligned such that the bullet loaded onto the punch will be pushed upward by the punch to enter into the central bore of the body, and a sizing insert with a precisely dimensioned internal diameter through which the bullet is passed to ensure accurate sizing. The sizing insert is slidably retained within the central bore of the body and axially contacts a piston member, which pressurizes a lubricant contained within a chamber. The lubricant chamber includes a central passage formed by a replaceable, sleeve shaped lubricating insert having a plurality of lubrication ports through which the lubricant in the chamber may flow. The punch is adapted to cause a bullet mounted on the punch to pass through the sizing die insert and thence into the lubricating insert where it is frictionally retained proximate to the lubrication ports while the punch is retracted and until being replaced and expelled by the next bullet being sized and passing into the lubricating insert. The device is readily disassembled and the sizing die insert and lubricating insert can be readily changed to correspond to different size bullets.

A principal aim of the present invention is to provide a bullet sizing and lubricating device, which meets the foregoing requirements and which is easy to use and performs both operations in a single operation of an ammunition reloading press.

Another and further object and aim of the present invention is to provide a new and improved a bullet sizing and lubricating device which has few moving parts and is therefore simple and economical to manufacture, use and maintain.

Another and further object and aim of the present invention is to provide a bullet sizing and lubricating device compactly mountable in a single stage of an ammunition reloading press.

Other objects and advantages of the invention will become apparent from the Description of the Preferred Embodiments and the Drawings and will be in part pointed out in more detail hereinafter. The invention consists in the features of construction, combination of elements and arrangement of parts exemplified in the construction hereinafter described and the scope of the invention will be indicated in the appended claims.

DESCRIPTION OF THE PREFERRED EMBODIMENT(S)

Figure 1:
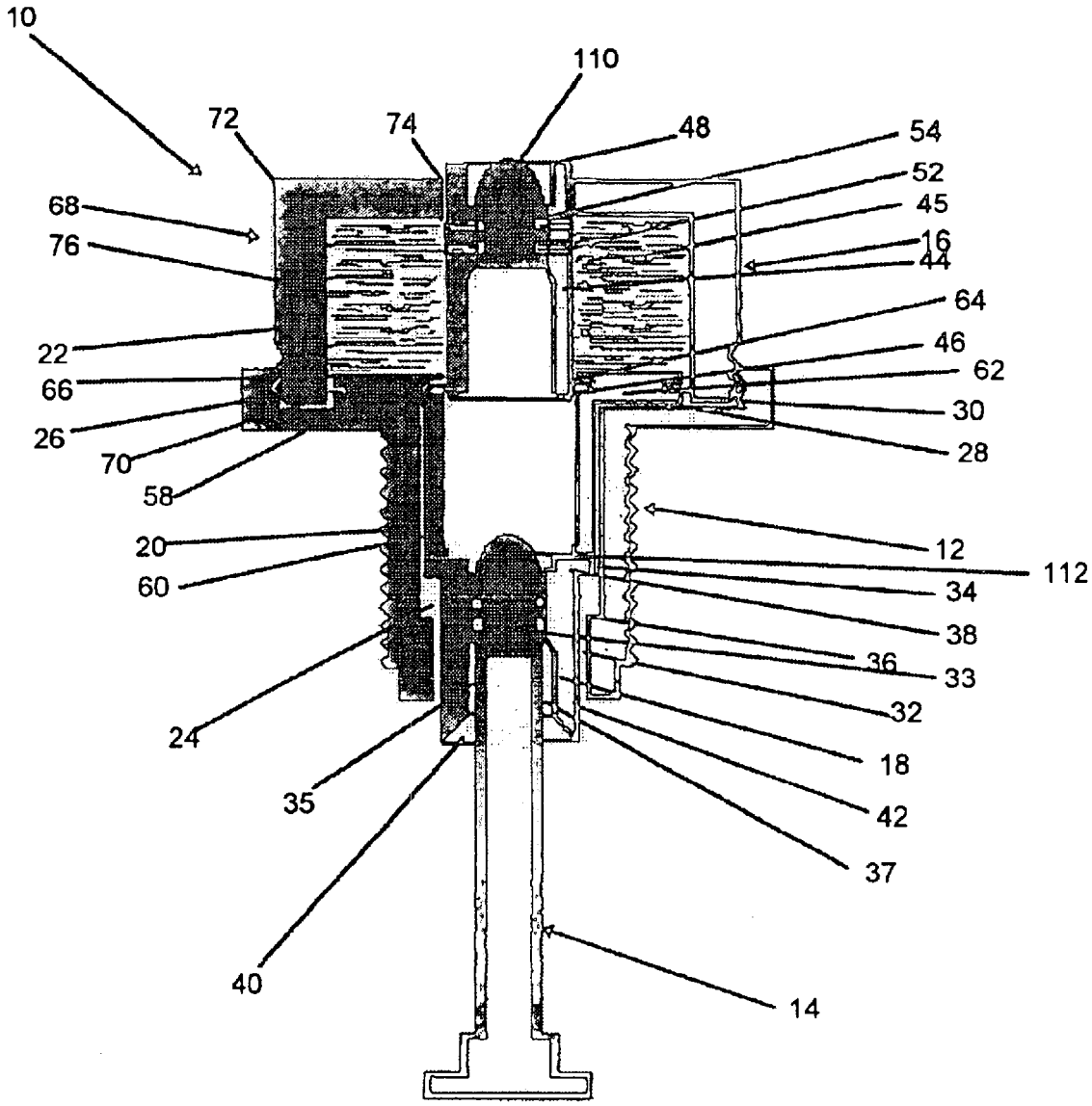
FIG. 1 is a longitudinal section view of a preferred embodiment of a bullet sizing and lubricating device constructed in accordance with the present invention, showing the device assembled and with bullets therein.
Figure 2:
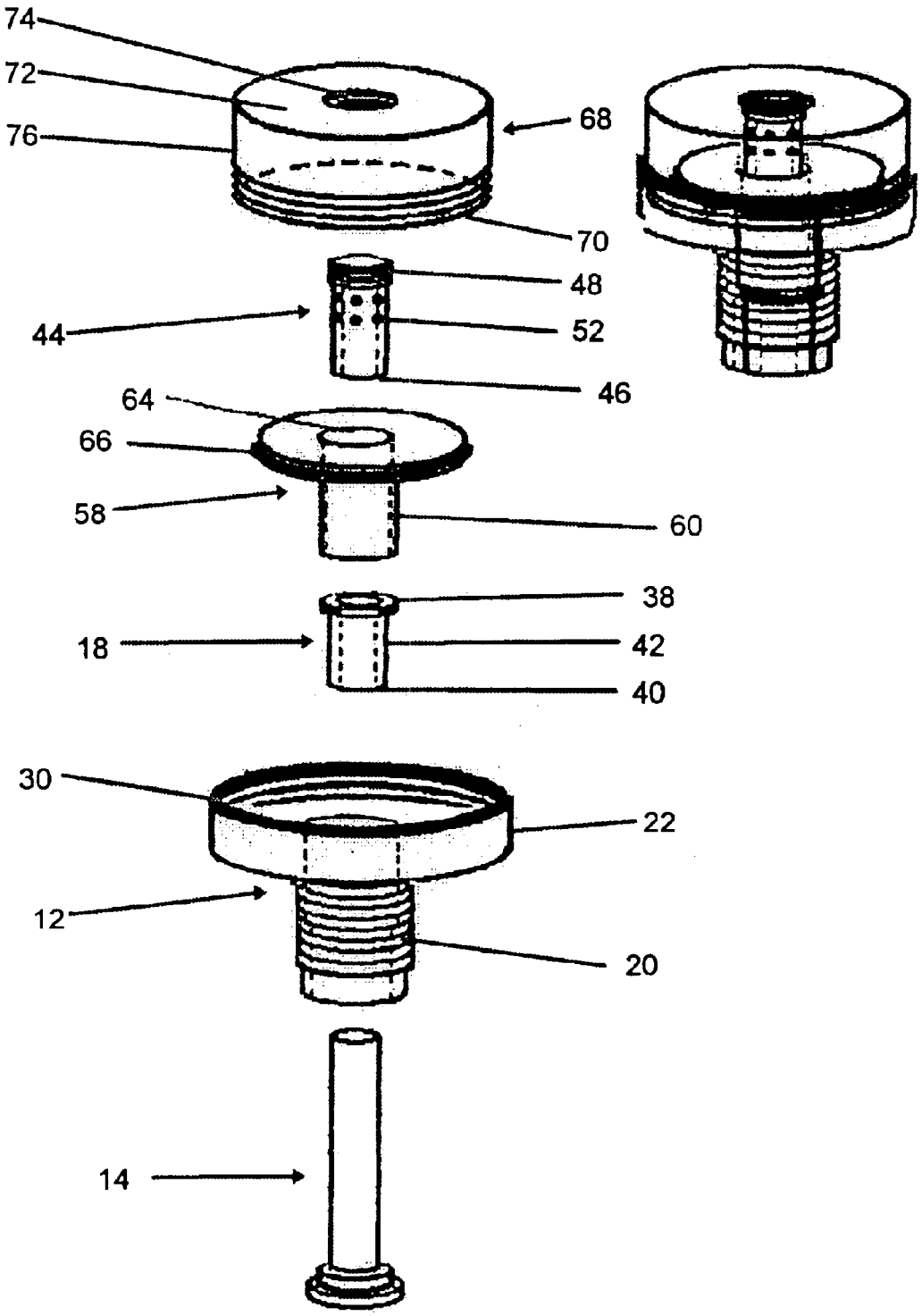
FIG. 2 is a cross section view of the unassembled parts of a preferred embodiment of a bullet sizing and lubricating device constructed in accordance with the present invention.
Figure 3:
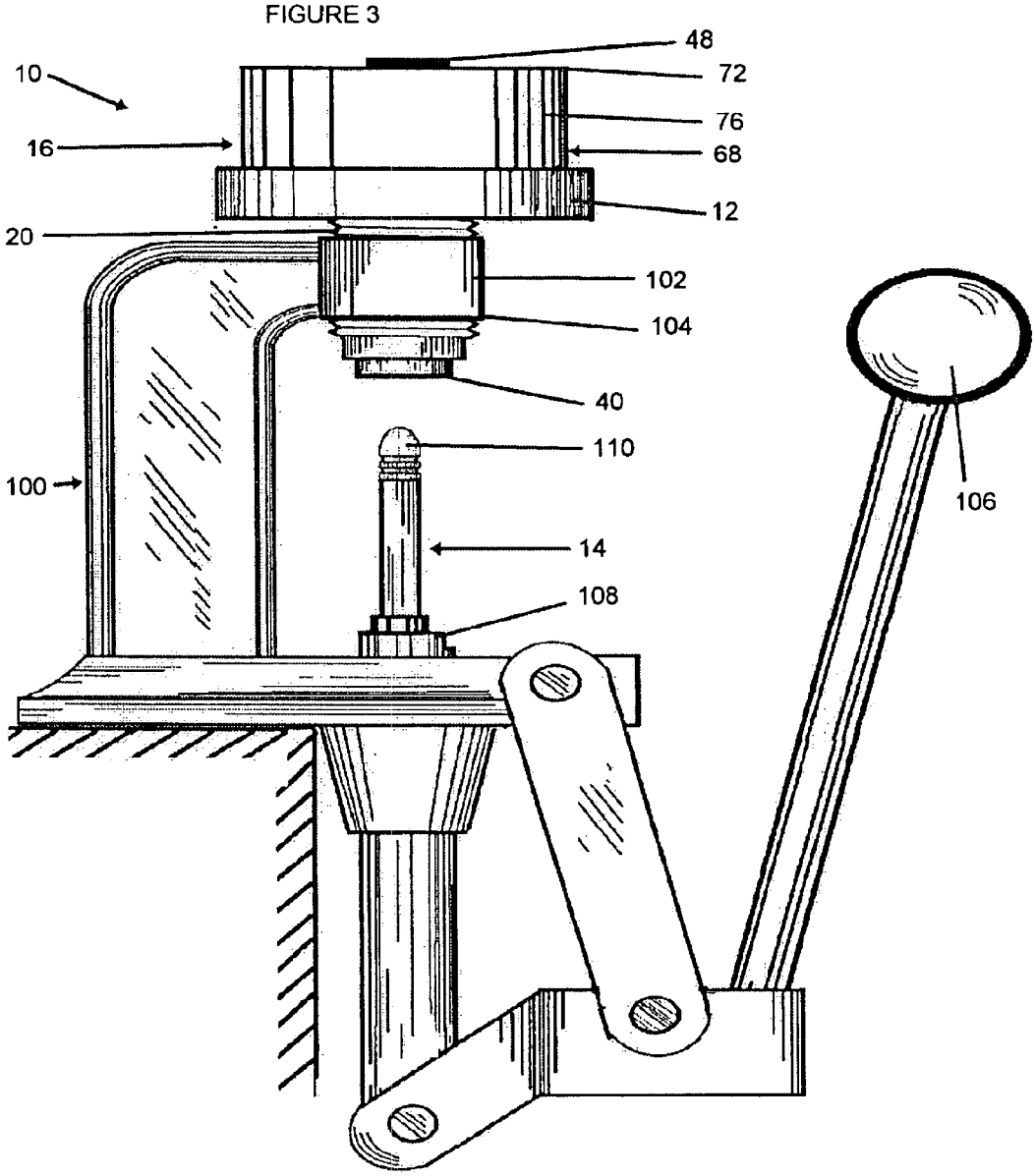
FIG. 3 is a side view of a preferred embodiment of a bullet sizing and lubricating device constructed in accordance with the present invention, showing the device assembled and installed in a reloading press.

With reference to the Drawings wherein like numerals represent like parts throughout the Figures, a preferred embodiment of a bullet sizing and lubricating device in accordance with the present invention is generally designated in FIGS. 1 and 3 by the numeral 10. Device 10 comprises a body 12, a punch 14, lubricant containing assembly 16, and a sizing die inert 18. Device 10 is adapted to be mounted on a reloading press 100 of conventional design, shown in FIG. 3, comprising a turret or platform 102 for supporting device 10 with a bore 104 with standard female screw threads, ⅞×14 threads for example, for receiving device 10, and the press having a handle 106 with leverage mechanism for causing a ram 108 to be forcibly advanced upwards towards the bottom of device 10. It will be appreciated that the terms "up", "down" "top" and "bottom" and the like are herein used to describe relative directions based on the assumption that device 10 is installed in a normal vertical position in a conventional reloading press as shown in FIG. 3, and that an alternative orientation would not affect the functioning of device 10. Punch 14 is mounted on the press ram 108 such that punch 14 forcefully advances into body 12 on activation of the press handle 106 and is withdrawn from body 12 when the press handle 106 is released or returned to its original position. Punch 14 is of slightly smaller diameter than the desired final diameter of the bullet being processed.

Device body 12 comprises a generally cylindrical lower section 20 with a central bore 24, and a generally cylindrical upper section 22 with a central bore 26. Upper body section central bore 26 having an internal diameter greater than the lower body section 20, creating a relatively broad, annular shoulder 28 separating upper body section 22 and lower body section 20. Upper body section 22 is formed with internal, female screw threads 30 and lower body section 20 is formed with external, male screw threads of an appropriate pitch such that body 12 can be threaded into female threads on the reloading press 100. Lower body section bore 24 comprises a lower part 32, an upper part 34 of slightly greater diameter than lower part 32, and an upward facing shoulder 36 between parts 32 and 34. Sizing die insert 18 comprises a central bore 35 comprised of a sizing section 33 that is precisely dimensioned to have an interior diameter the same as the exact dimension to which the processed bullet is to be sized and a lower guide section 37 of slightly larger diameter and a chamfered transition between sections 37 and 33. The sizing die insert 18 is generally tubular with a flange 38 at a top end and a chamfered opening 40 at the other lower end, and a cylindrical external surface 42 there between. Sizing die insert external surface 42 is slightly lesser diameter than the internal diameter of body lower section 20 so as to be slidable therein and sizing die flange 38 is of greater diameter than the internal diameter of body lower section 20 so as to engage shoulder 36 preventing the insert 18 from sliding out the bottom of body 12. Sizing die insert 18 is slidable within the central bore 24 of body lower section 20 but its travel is limited in the downward direction.

Device 10 lubricant assembly 16 comprises a lubricating insert 44 having a generally cylindrical, tubular shape with a lower, open, chamfered end 46 and an upper, open, male screw threaded end 48 with an intermediate section 54 of slightly reduced interior diameter of diameter corresponding with diameter of the finished bullet. A plurality of lubricating ports 52 circumferentially perforate intermediate section 54 in one or more rings corresponding to the number of annular grooves on the bullet to be processed (frequently bullets have two annular grooves). Lubricant assembly 16 further comprises a piston member 58 having a generally tubular lower section 60 of inside diameter greater than the bullet to be processed and approximately the same diameter as the sizing die insert flange 38 and an upper, annular piston head section 62. Piston head section 62 is shaped as a flat annulus with "O" ring seals on the inner and outer edges 64 and 66 thereof. Piston head inner edge 64 is the upper end of the interior of piston lower section 60 and corresponds to the outer diameter of lubricating insert 44. Lubricant assembly 16 further comprises a cup shaped lubricant container member 68 with a cylindrical wall 76, a bottom, open end 70 and a top, closed end 72. Lubricant container closed end 72 is shaped as a flat disc with a central opening 74 having female screw threads corresponding to the male screw threaded end 48 of lubricating insert 44. The inside diameter of the lubricant container wall 76 is corresponds to the outer edge 66 of piston head section 62 such that the outer edge 66 can be sealingly engage the inside of wall 76 and be slideable therein. The bottom of the outer surface of wall 76 is formed with male screw threads proximate to open end 70 and corresponding to the female screw threads 30 on upper body section 22.

Lubricant assembly 16 is assembled by inserting lubricating insert 44 through the open end 70 of lubricant container member 68 and screwing the threaded end 48 of lubricating insert 44 into the screw threads into the bottom of lubricant container closed end opening 74. In the lubricant assembly 16, the wall 76 and lubricating insert 44 are coaxial and an open, rectangular toroid shaped chamber 45 is partially formed between lubricant container member 68 and lubricating insert 44, into which a suitable bullet lubricant is placed. The loaded lubricant is then sealed within chamber 45, which is completed by the insertion of piston head 62 into lubricant container open end 70, the piston head "o" rings sealingly engaging wall 76 and lubricating insert 44, whereby piston head 62 surrounds lubricating insert 44, filling and sealing the open annular gap between lubricating insert 44 and the inside of lubricant container wall 76, retaining the lubricant within lubricant chamber 45. On final assembly of device 10, body 12 is screwed into the reloading press and sizing die insert 18 is inserted from the top into central bore 26 when insert 18 is retained by the engagement of flange 38 with shoulder 36, and the assembled lubricating assembly 16 is threaded into upper body section threads 30. In fully assembled device 10, piston member lower section 60 is slidingly received within the upper part 34 of the central bore 24 and constitutes an upper restraint on sizing die insert 18. In assembled device 10, body 12, sizing insert 18 and lubricating assembly 16 are generally rotationally symmetrical about a central axis and are mutually coaxial, forming a central, straight and axially extending bullet passageway through device 10. Lubricant member top end 72, piston head 62, and shoulders 28 and 36 are all flat, annular and normal to the central axis of device 10.

Operation of device 10 is commenced by placing a bullet to be processed, designated by the numeral 110 in FIGS. 1 and 3 on punch 14 and the press handle 106 activated to advance bullet 110 into device 10 first engaging and passing through sizing die insert 18, which imparts the desired diameter size to the exterior of bullet 110. The length of punch 14 and the installation depth of device 10 in bore 102 are correlated to cause bullet 110 then to pass into the lubricating insert intermediate section 54, where bullet 110 stops at the full extension of punch 14. Punch 14 is then withdrawn by reversal of the press ram and the bullet 110 is retained by a friction fit within intermediate section 54 at a position, which places the annular bullet grooves proximate to the lubricating ports 52. The next bullet to be processed, designated as 112 in FIG. 1, is then placed on punch 14 and by operation of the press, advanced into and through sizing die insert 18 and into the position occupied by the initial bullet 110 within lubricating insert intermediate section 54, expelling the initial bullet from device 10. As a bullet enters sizing die insert 18, it is aligned and guided by guide section 37 and engages sizing section 33, and the interference between the bullet and sizing die insert 18, specifically sizing section 33, results in generation of an upward, axial force on insert 18. In response to the axial force, sizing die insert 18 first slides upward until flange 38 contacts piston lower section 60. As a bullet is passing through sizing die insert 18, after insert 18 contacts piston section 60, the continued axial force, which by the engagement of insert flange 38 against piston lower section 60 is communicated to piston member 58, pressurizes the lubricant within lubricating assembly 16. The pressurized lubricant correspondingly flows through lubricating ports 52 into the bullet grooves, lubricating the prior bullet before it is expelled from device 10. When a bullet has passed through sizing die insert 18, the axial force ceases and sizing die insert 18 drops back and the lubricant is no longer pressurized and no longer flows through ports 52.

It will be anticipated that other possible means for mounting and operating device 10 exist, the preferred means of threading into an ammunition reloading press a described herein being only one example. As a further example, device 10 could be secured in any manner so long as the punch can be forcibly advanced the prescribed distance axially through device 10 without departing from the scope of the present invention.

It will be anticipated that the sizing die insert and lubricating insert can readily be replaced when different sized bullets are to be processed. Further, a variety of materials may be used in the manufacture of the parts of device 10 with a limitation that the material of the sizing die insert must be able to withstand the stress of the sizing process without distortion, which generally requires that it be harder than the bullet material.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

I claim:

1. A bullet sizing and lubricating device for use with an ammunition reloading press having a tool mounting stage and a ram for forcibly advancing a bullet into a tool mounted on the stage, the device comprising a generally cylindrical sizing die member having a bore of predetermined internal diameter and bullet lubricating assembly comprising a piston actuated by interaction with the sizing die member, a lubricant containing member within which is formed a chamber having an open end into which the piston is inserted, and a central sleeve having a central bore coaxial with the sizing die insert bore and having at least one opening allowing fluid communication between the sleeve bore and the lubricant containing member chamber.

2. The bullet sizing and lubricating device of claim 1, wherein the sizing die insert and piston are linearly assembled and slidably contained within a body mountable on an ammunition reloading press.

3. The bullet sizing and lubricating device of claim 2, wherein the central sleeve of the lubricating assembly comprises a plurality of openings through which a bullet within the bore is exposed to lubricant within the lubricant containing chamber.

4. The bullet sizing and lubricating device of claim 3, wherein the device further comprises a punch mountable on the ram member of a reloading press, the punch having an end adapted to receive a bullet to be sized and lubricated and a predetermined length with respect to the press dimensions and the dimensions and mounting of the claimed device, such that the operation of the press causes a bullet received by the punch end to pass through the sizing die inert and into the bullet lubricating means to a level where the bullet grooves are proximate to the lubricant orifice.

5. The bullet sizing and lubricating device of claim 4 wherein the lubricating assembly sleeve further comprises means for releasably retaining a bullet proximate to the sleeve openings, whereby excessive flow of lubricant from the orifice is blocked by the presence of a retained bullet.

* * * * *